US010399379B2

(12) United States Patent
Johnston

(10) Patent No.: US 10,399,379 B2
(45) Date of Patent: Sep. 3, 2019

(54) PAINT EDGER APPARATUS

(71) Applicant: Gary Lawrence Johnston, Cowarts, AL (US)

(72) Inventor: Gary Lawrence Johnston, Cowarts, AL (US)

( * ) Notice: Subject to any disclaimer, the term of this patent is extended or adjusted under 35 U.S.C. 154(b) by 0 days.

(21) Appl. No.: 15/713,613

(22) Filed: Sep. 23, 2017

(65) Prior Publication Data

US 2019/0092088 A1 Mar. 28, 2019

(51) Int. Cl.

*B05C 21/00* (2006.01)
*B44D 3/22* (2006.01)
*B05B 12/20* (2018.01)

(52) U.S. Cl.

CPC ..... *B44D 3/225* (2013.01); *B05B 12/20* (2018.02); *B05C 21/005* (2013.01)

(58) Field of Classification Search

None
See application file for complete search history.

(56) References Cited

U.S. PATENT DOCUMENTS 2,363,842 A * 11/1944 Duggan ..... B05B 12/20 118/505
2,398,901 A * 4/1946 West ..... H02G 3/121 174/53
5,285,014 A * 2/1994 Gilchrist ..... H01R 13/443 174/67
9,061,305 B1 * 6/2015 Martinez ..... B05B 15/001

* cited by examiner

*Primary Examiner* — Jethro M. Pence

(57) ABSTRACT

A Paint Edger Apparatus comprising mainly a Paint Protector Member and a Hand Engagement Member. The Paint Protector Member is basically composed of rigid structure having a center member with sides members mounted thereon which form a generally hollow rectangular-shaped structure. The side members are slanted downward and away from the center member. The center member also has opening members through which a Hand Engagement Member is coupled so that it may be moved towards and away from the center member. The Hand Engagement Member has a generally horizontal handle member which is positioned above the center member of the Paint Protector Member. Mounted on each end of the handle member are support members which extend downward through the opening members located on the center member of the Paint Protector Member. A spring member is also included as part of the Hand Engagement Member which provides resistance to the movement of the Hand Engagement Member in the downward direction. At the lower end of the support members are attachment members which are used to attach the Hand Engagement Member to a solid surface, such as plastic, glass, mirror, wood, drywall, etc.

12 Claims, 6 Drawing Sheets

PAINT EDGER APPARATUS

BACKGROUND OF THE INVENTION

This invention relates to a Paint Edger Apparatus which is used to paint edges along items such as window frames, trim and molding, baseboards, paint transition lines, etc. Materials commonly used today for this task are masking tape, a hand-held edger, and glass sealing film. This apparatus is unique in that it can be used on any solid surface, it can greatly reduce the amount of preparatory work for painting edges, and it is self-standing which frees up the users hand for more important paint related matters.

The apparatus comprises mainly a Paint Protector Member and a Hand Engagement Member. The Paint Protector Member is basically composed of a rigid structure having a center member with four sides members mounted thereon which form a generally hollow rectangular-shaped structure. The sides are slanted downward and away from the center member. The center member also has opening members through which a Hand Engagement Member is coupled. The Hand Engagement Member is coupled to the center member so that it may be moved towards and away from the center member. The Hand Engagement Member has a generally horizontal handle member which is positioned above the center member of the Paint Protector Member. Mounted on each end of the handle member are support members which extend downward and through the opening members located on the center member of the Paint Protector Member. A spring member is also included as part of the Hand Engagement Member which provides resistance to the movement of the Hand Engagement Member in the downward direction. At the lower end of the support members are attachment members which attach the Hand Engagement Member to a solid surface, such as plastic, glass, wood, drywall, etc. The construction of the apparatus is such that it may be placed and attached against a solid surface, and allow the user to paint an object which is joined to the solid surface, such as a window frame or molding, without getting much paint upon the solid surface when the object is painted. It allows the user to paint an generally linear edge next to the solid surface.

SUMMARY AND OBJECTS OF THE INVENTION

It is the object of this invention to provide a Paint Edger Apparatus which may provide the user an efficient and inexpensive means for painting edges along solid objects such as plastic, glass, trim and molding, drywall, wood, etc. The main purpose of this application is to demonstrate an apparatus which performs the stated function, and to demonstrate the many options and configurations this apparatus may take on.

Briefly stated, the apparatus that forms the basis of the invention comprises a Paint Protector Member and a Hand Engagement Member. As mentioned, the Paint Protector Member is basically composed of a Center Member with four Side Members which extend downward and away from the Center Member, forming a generally hollow rectangular-shaped structure. The Center Member has Opening Members through which a Hand Engagement Member is coupled so that it may be moved towards and away from the Center Member. The Hand Engagement Member comprises a Handle Member with Support Members rigidly mounted at each end. These Support Members extend downward and through the Opening Members of the Center Member and are used to couple the Hand Engagement Member to the Paint Protector Member. Located at the end of each Support Member is an Attachment Member which is used to attach the Hand Engagement Member to a solid surface. The Attachment Members may be any conventional type of Attachment Members commonly in use, such as suction cups and gel pads. Preferably, the Attachment Members are normally located at a horizontal elevation which is above the normal horizontal elevation of the bottom edges of the Side Members of the Paint Protector Member. This allows the Side Members to make contact with the solid surface before the Attachment Members. This further allows the apparatus to be more easily placed against and moved along a solid surface before it is attached for use. Spring Members are also a part of the Hand Engagement Member. They are positioned over the Support Members and engage the Center Member in order to resist the movement of the Handle Member towards the Center Member. They also are used to push the Side Members more firmly against a solid surface when the apparatus is in use.

In order to operate the apparatus, the user pushes the Paint Edger Apparatus against the solid surface which needs to be protected from paint. These solid surfaces include but are not limited to plastic, glass, trim and molding, drywall, wood, etc. As the apparatus is pushed against the solid surface using the Handle Member, the Side Members of the Paint Protector Member will come into contact with the solid surface first. As the user continues to push further, the Attachment Members of the Hand Engagement Member will move towards the surface and also come into contact with, and attach themselves to, the solid surface. The Attachment Members keep the apparatus in contact with and in place against the solid surface. The Spring Members keeps the Side Members of the Paint Protector Member in firm contact with the solid surface, prohibiting any paint from leaking underneath. The bottom edges of the Side Members may also have an elastic type feature so that a more sealed effect may be noticed. To remove the apparatus, the user will just pull against the Handle Member and dislodge the Attachment Members. The Spring Members will then push the Hand Engagement Member away from the Paint Protector Member, returning everything to its normal and unused position. Paint may then be wiped away from the Side Members with a cloth for quick reuse.

The Paint Edger Apparatus may be used in any number of applications. These include but are not limited to painting the wood on windows, painting decorative trim and molding, painting transition lines on drywall, and decorative painting of glass, wood, drywall, etc. Preferably, the apparatus should be constructed of a paint resistance material so that paint will not stick to its surface, or may be easily removed. This is especially true of the Paint Protector Member.

DETAILED DESCRIPTION OF THE PREFERRED EMBODIMENT

Figure 1B:
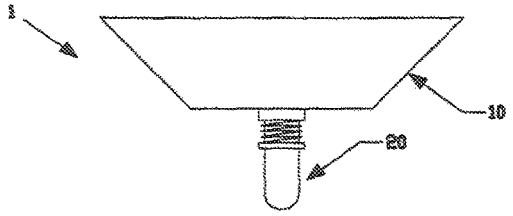
FIG. 1B is a top view of the Paint Edger Apparatus.
Figure 1D:
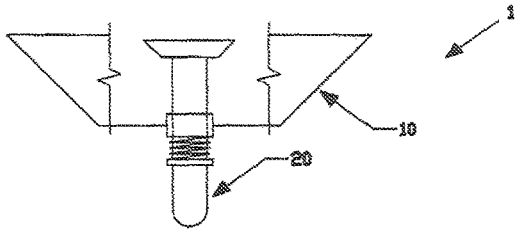
FIG. 1D is a top view of the Paint Edger Apparatus better demonstrating its various components.
Figure 1A:
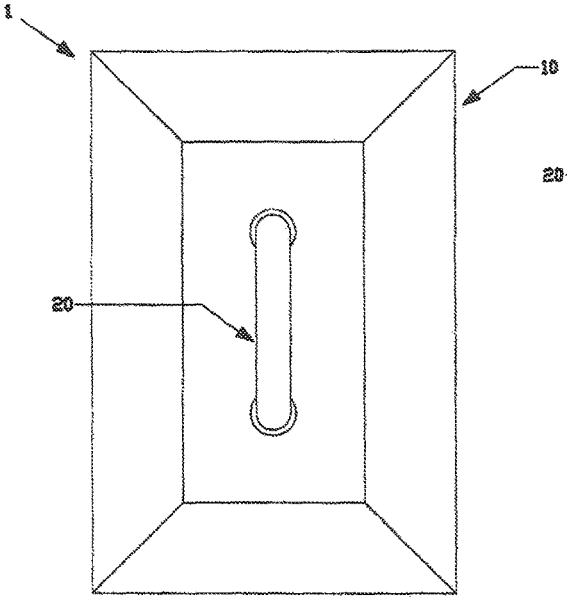
FIG. 1A is a front view of the Paint Edger Apparatus.
Figure 1C:
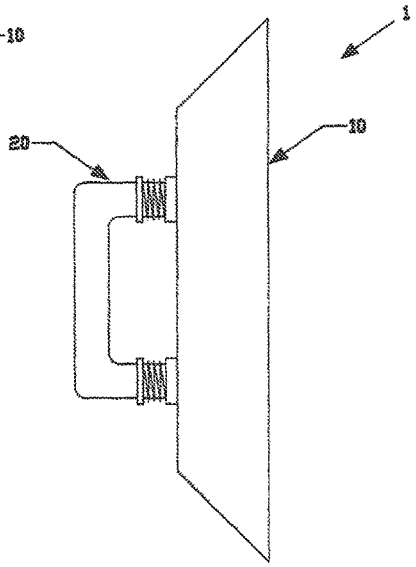
FIG. 1C is a side view of the Paint Edger Apparatus.

Before explaining in detail the present invention, it is to be understood that the invention is not limited in its application to the details of construction or arrangement of parts illustrated in the accompanying drawings, since the invention is capable of other embodiments and of being practiced or carried out in various ways. Also, it is to be understood that the phraseology and terminology employed herein is for the purpose of description, and not limitation.

As best can be seen by references to the drawings, and in particular to FIGS. 1A-1D, the Paint Edger Apparatus that forms the basis of the present invention is designated generally by the reference numeral 1, and comprises a Paint Protector Member 10 and a Hand Engagement Member 20. The Hand Engagement Member 20 is coupled to the Paint Protector Member 10 so that portions extend above and within the Paint Protector Member 10, and it may be move towards and away from the Paint Protector Member.

Figure 2B:
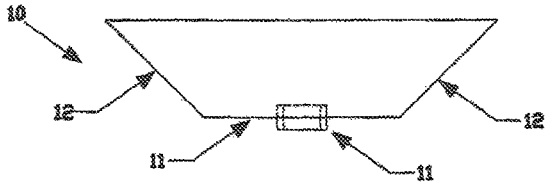
FIG. 2B is a top view of the Paint Protector Member of the Paint Edger Apparatus.
Figure 2A:
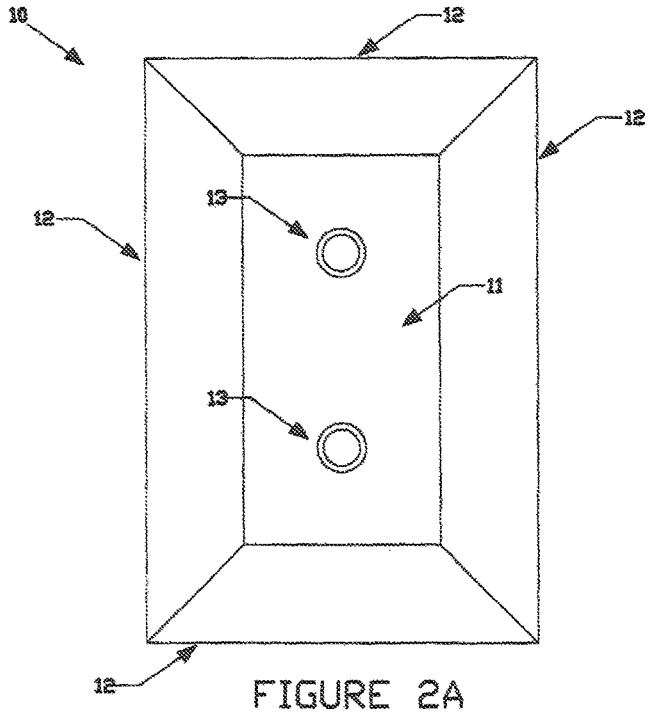
FIG. 2A is a front view of the Paint Protector Member of the Paint Edger Apparatus.
Figure 2C:
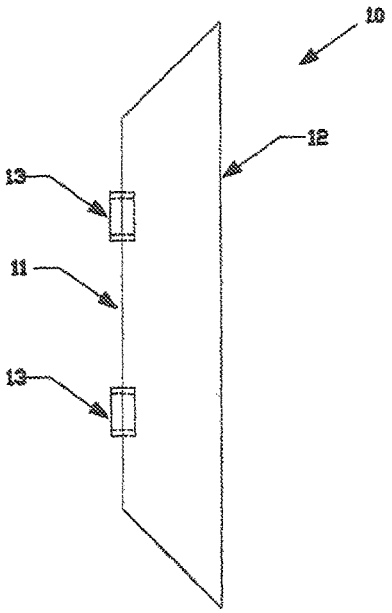
FIG. 2C is a side view of the Paint Protector Member of the Paint Edger Apparatus.

As may be seen in FIGS. 2A-2C, the Paint Protector Member 10 comprises a Center Member 11 with outwardly and downwardly extending Side Members 12 which are rigidly attached. Center Member 11 has Opening Members 13 which are used to moveably couple to the Hand Engagement Member. The Center Member 11 and Side Members 12 create a generally hollow rectangular-shaped structure, with the hollow area open in the downward direction.

Figure 3B:
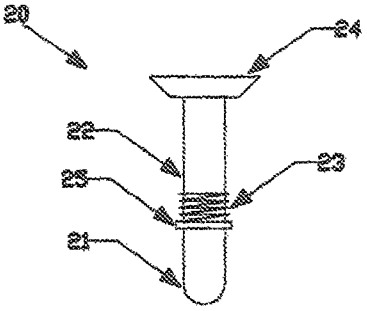
FIG. 3B is a top view of the Hand Engagement Member of the Paint Edger Apparatus.
Figure 3A:
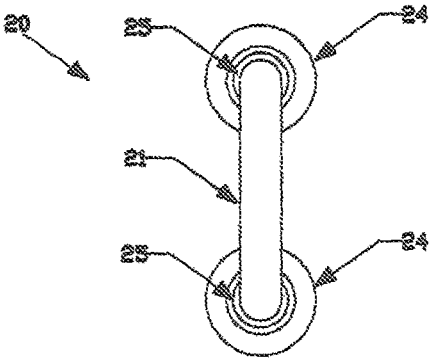
FIG. 3A is a front view of the Hand Engagement Member of the Paint Edger Apparatus.
Figure 3C:
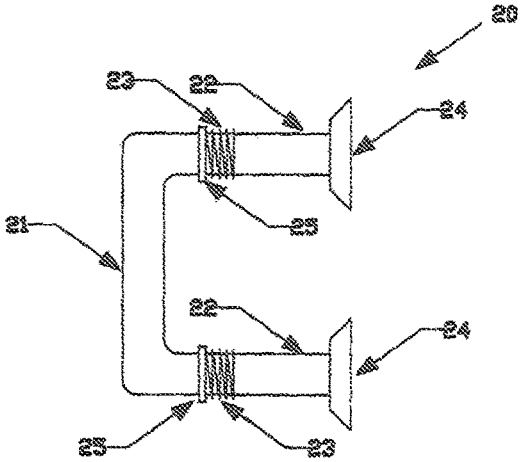
FIG. 3C is a side view of the Hand Engagement Member of the Paint Edger Apparatus.

FIGS. 3A, 3B, and 3C demonstrate the Hand Engagement Member 20. Hand Engagement Member 20 comprises a generally horizontal Handle Member 21 with Support Members 22 mounted at each end and which extending in the generally downward direction. At the end of each Support Member 22 is an Attachment Member 24. A Spring Member 23 may be placed over each Support Member 22 and may provide resistance to the movement of the Hand Engagement Member 20 towards the Paint Protector Member. Stop Member 25 may be used to keep Spring Member 23 in place. Attachment Member 23 is shown as a conventional suction cup, but other common attachment items, such as gel pads, may be utilized. It is preferable that the Hand Engagement Member utilizes two Support Member and two Attachment Members, but it may prove possible to utilize only one of each.

Figures 4A, 4B, 4C:
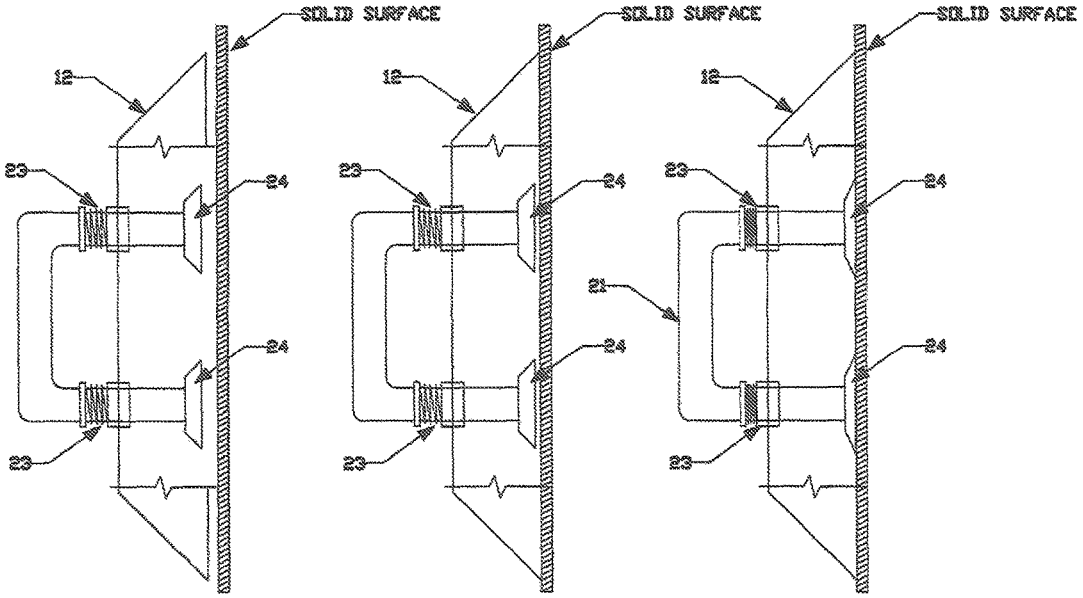
FIG. 4A is a side view of the Paint Edger Apparatus demonstrating its operation.
FIG. 4B is another side view of the Paint Edger Apparatus demonstrating its operation.
FIG. 4C is another side view of the Paint Edger Apparatus demonstrating its operation.

FIGS. 4A, 4B, and 4C show the Paint Edger Apparatus in operation. In its initial state, as seen in FIG. 4A, the Attachment Members 24 of the Hand Engagement Member are at an level which is above the level of the bottom edges of the Side Members 12, and within the hollow area of the Paint Protector Apparatus. The Spring Members 23 are uncompressed. As the apparatus is pushed against a solid surface, as shown in FIG. 4B, the bottom edges of the Side Members 12 will come into contact with the solid surface first. Then, as shown in FIG. 4C, pushing the Hand Engagement Member further will cause the Attachment Members 24 to also come into contact with the solid wall. The Attachment Members 24 are the items that attach the Hand Engagement Member, and thus the Paint Protector Member, to the solid surface. The bottom edges of the Side Members 12 are still in contact with the solid surface, and are kept in firm contact with the solid surface by the Spring Members 23 of the Hand Engagement Member. The bottom edges of the Side Members 12 may also have an elastic type feature so that a more sealed effect may be noticed. The Spring Members 23 are in a compressed state at this point. The Stop Members 25 are used to keep the Spring Members 23 in compression.

Since the Side members 12 and Attachment Members 24 are at initially at different levels, the bottom edges of the Side Members 12 will contact the solid surface first. The apparatus will not become attached to the solid surface until the Attachment Members 24 attach themselves to the solid surface. This feature allows the apparatus to be pressed lightly against the solid surface and then be moved along the solid surface until the desired location of attachment is determined. Once the desired location is found, the Hand Engagement Member is pushed further downward, so that the Attachment Members come into contact with, and attach themselves to, the solid surface. It is preferable that the apparatus be constructed of a paint resistance material, especially the Paint Protector Member.

Figure 5:
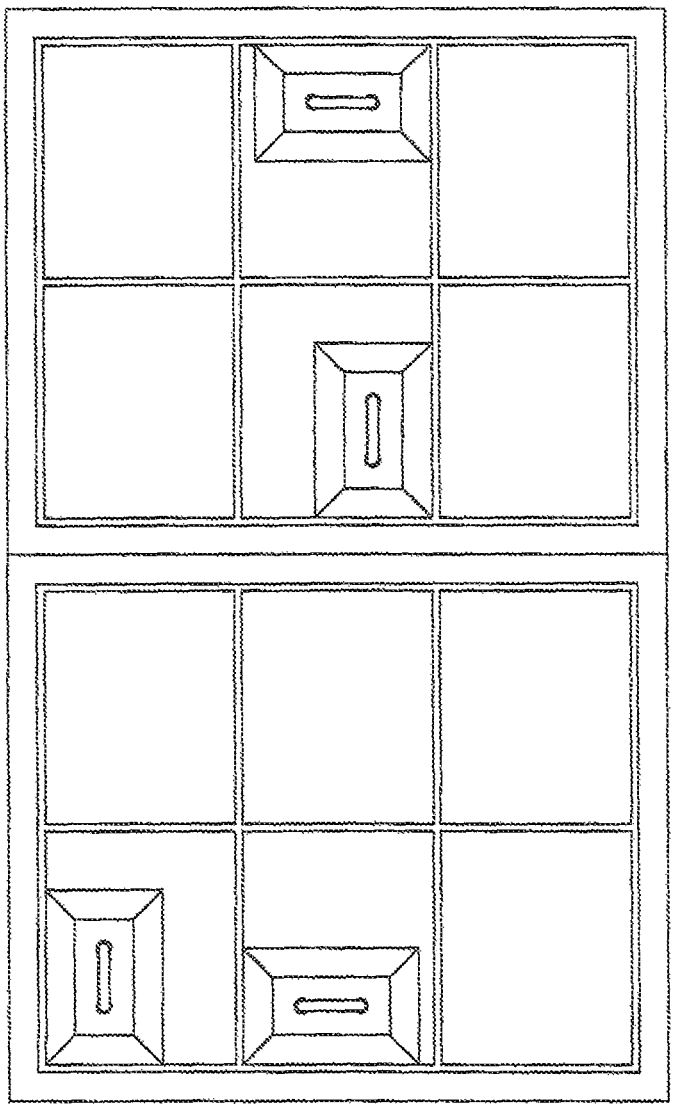
FIG. 5 is a front view of the Paint Edger Apparatus demonstrating how it can be used to paint the window pane wood on a conventional window.

FIG. 5 demonstrates how the Paint Edger Apparatus may be attached to the panes of a window in order to paint the wood window pane separators without getting paint on the window pane itself. As shown, the apparatus may be position in any manner which makes painting the window pane separators easier. In this instance, the apparatus attaches to the plastic or glass window pane.

Figure 6:
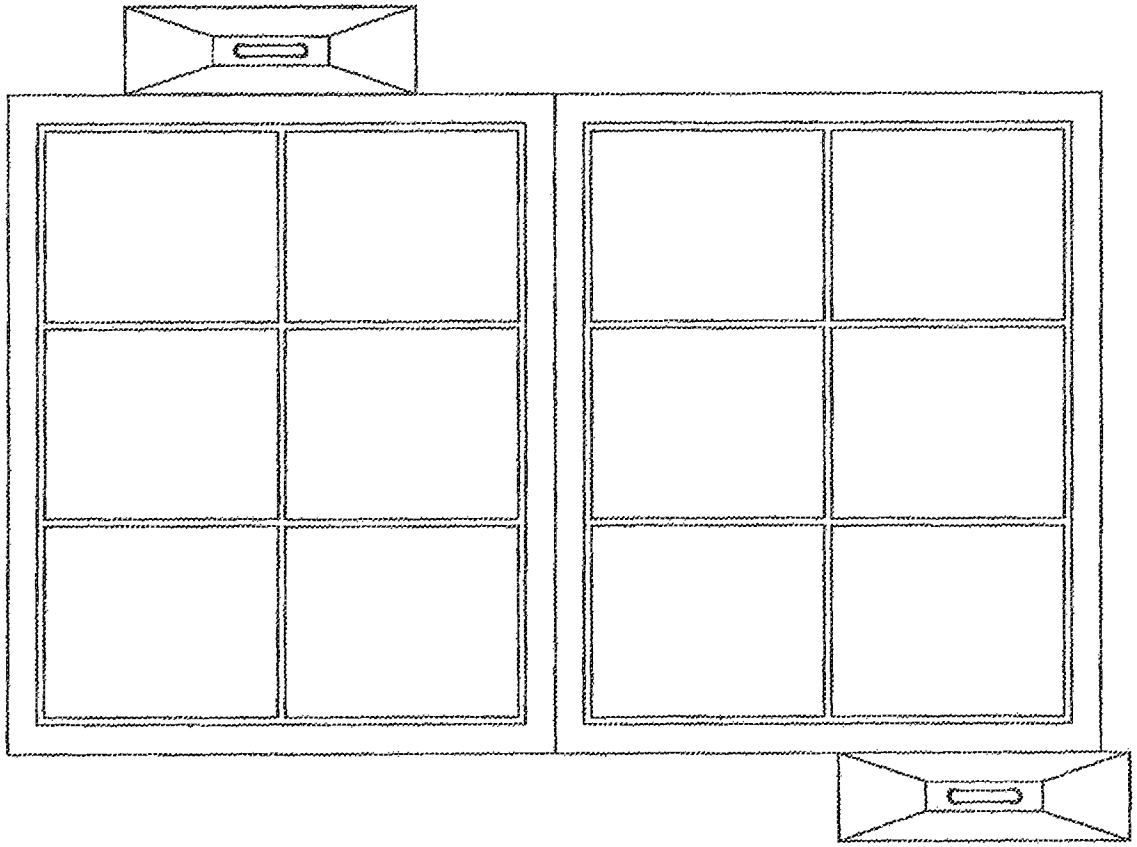
FIG. 6 is a front view of the Paint Edger Apparatus demonstrating how it can be used to paint the trim wood on a conventional window.

FIG. 6 demonstrates how the apparatus may be used to paint the trim and molding located along a window frame. The figure also demonstrates how the apparatus may take on a different form and look, with this version being narrower and longer. In this instance, the apparatus is attached to a wall constructed of a solid material such as drywall or wood, which surrounds the window frame. As mentioned previously, the apparatus may also be utilized for decorative painting on glass, plastic, mirror, walls, etc., and may have a form and shape which better suits its desired use. It may prove desirable to have an apparatus with a L-shaped form to better paint exterior corners, such as those found on window trim and molding.

Many variations of the numerical display apparatus exist, along with the configurations described above. While it will be apparent that the preferred embodiment of the invention herein disclosed is well calculated to fulfill the objects above stated, it will be appreciated that the invention is susceptible to modification, variation, and change without departing from the proper scope or fair meaning of the subjoined claims.

I claim:

1. A paint edger apparatus comprising:

a paint protector member having a rigid structure, said rigid structure having a center member and side members which extend outward and downward at an angle from said center member to create a hollow open area underneath;

a hand engagement member having an elongated handle member with at least one support member rigidly and perpendicularly mounted at one of its ends, said at least one support member configured to moveably couple said hand engagement member to said paint protector member, said at least one support member extending away from said handle member and into said hollow area of said paint protector member and having an attachment member mounted at its end and positioned within said hollow area;

said handle member and said paint protector member being located in parallel planes;

whereby said handle member of said hand engagement member is to push said attachment member of said hand engagement member against a solid surface, said attachment member configured to attach said hand engagement member and said paint protector member against said solid surface, such that said paint edger apparatus is configured to prohibit paint from being unintentionally applied to said solid surface.

2. The paint edger apparatus as claimed in claim 1, said center member of said paint protector member further having at least one open member mounted thereon, said open member being open into said hollow open area of said paint protector member; said at least one support member of said hand engagement member being sized to fit within said at least one open member of said paint protector member and moveably coupling said hand engagement member to said paint protector member such that said hand engagement member may be moved towards and away from said paint protector member.

3. The paint edger apparatus as claimed in claim 1, said hand engagement member further having a spring member mounted upon said support member, said spring member used to resist movement of said hand engagement member towards said paint protector member, and being used to firmly press said side members of said paint protector member against said solid surface.

4. The paint edger apparatus as claimed in claim 1, said side members of said paint protector member having bottom edges, said attachment member of said hand engagement member being positioned at a level which is higher than the level of said bottom edges of said side member of said paint protector member.

5. The paint edger apparatus as claimed in claim 1, said attachment members of said hand engagement member being suction cups.

6. A paint edger apparatus comprising:

a paint protector member having a rigid structure, said rigid structure having a center member and side members which extend outward and downward at an angle from said center member to create a hollow open area underneath, said center member also having open members which open into said hollow area;

a hand engagement member having an elongated handle member with support members rigidly and perpendicularly mounted at each end, said support members sized to fit within said open members of said paint protector member and moveably coupling said hand engagement member to said paint protector member, said support members extending away from said handle member and into said hollow area of said paint protector member and having an attachment member mounted at each end and positioned within said hollow area;

said handle member and said paint protector member being located in parallel planes;

whereby said handle member of said hand engagement member is to push said attachment members of said hand engagement member against a solid surface, said attachment members configured to attach said hand engagement member and said paint protector member against said solid surface such that said paint edger apparatus is configured to prohibit paint from being applied to said solid surface.

7. The paint edger apparatus as claimed in claim 6, said hand engagement member further having a spring member mounted upon each of said support members, said spring members used to resist movement of said hand engagement member towards said paint protector member, and being used to firmly press said side member of said paint protector member against said solid surface.

8. The paint edger apparatus as claimed in claim 6, said side members of said paint protector member having bottom edges, said attachment member of said hand engagement member being positioned at a level which is higher than the level of said bottom edges of said side members of said paint protector member.

9. The paint edger apparatus as claimed in claim 6, said attachment members of said hand engagement member being suction cups.

10. A paint edger apparatus comprising:

a paint protector member having a rigid structure, said rigid structure having a center member and side members which extend outward and downward at an angle from said center member to create a hollow open area underneath, said center member also having open members which open into said hollow area, said side members having bottom edges;

a hand engagement member having an elongated handle member with support members rigidly and perpendicularly mounted at each end, said support members sized to fit within said open members of said paint protector member and moveably coupling said hand engagement member to said paint protector member, said support members extending away from said handle member and into said hollow area of said paint protector member and having an attachment member mounted at each end and positioned within said hollow area;

said handle member and said paint protector member being located in parallel planes;

said attachment member of said hand engagement member being positioned at a level which is higher than the level of said bottom edges of said side members of said paint protector member; and a spring member mounted upon each of said support members, said spring members configured to resist movement of said hand engagement member towards said paint protector member, and configured to firmly press said side member of said paint protector member against said solid surface;

whereby said handle member of said hand engagement member is to push said attachment members of said hand engagement member against a solid surface, said attachment members configured to attach said hand engagement member and said paint protector member against said solid surface such that said paint edger apparatus is configured to prohibit paint from being applied to said solid surface.

11. The paint edger apparatus as claimed in claim 10, said attachment members of said hand engagement member being suction cups.

12. The paint edger apparatus as claimed in claims 1, 6, and 10, said attachment members of said hand engagement member being gel pads.

* * * * *